US007231785B2

(12) United States Patent
Wilhelm

(10) Patent No.: US 7,231,785 B2
(45) Date of Patent: Jun. 19, 2007

(54) COLUMN SYSTEM AND PROCESS FOR PRODUCING SAME

(75) Inventor: Stefan Wilhelm, Unterhaching (DE)

(73) Assignee: Linde Aktiengesellschaft, Wiesbaden (DE)

( * ) Notice: Subject to any disclaimer, the term of this patent is extended or adjusted under 35 U.S.C. 154(b) by 423 days.

(21) Appl. No.: 10/835,263

(22) Filed: Apr. 30, 2004

(65) Prior Publication Data

US 2004/0255450 A1 Dec. 23, 2004

(30) Foreign Application Priority Data

Apr. 30, 2003 (DE) ..... 103 19 755

(51) Int. Cl.
*F25J 3/00* (2006.01)

(52) U.S. Cl. ..... 62/643; 62/617; 62/902

(58) Field of Classification Search ..... 62/902, 62/643, 617; 220/520.1
See application file for complete search history.

(56) References Cited

U.S. PATENT DOCUMENTS 2,592,974 A * 4/1952 Sulfrian ..... 220/560.1
2,926,810 A * 3/1960 Yeager ..... 220/560.1
3,021,027 A * 2/1962 Claxton ..... 220/560.1
3,110,157 A 11/1963 Radd
3,115,983 A * 12/1963 Wissmiller ..... 220/560.1
4,184,609 A * 1/1980 Vorreiter ..... 220/560.1
4,848,103 A * 7/1989 Pelc et al. ..... 62/51.1
5,379,981 A * 1/1995 Leiderer ..... 248/550
6,202,305 B1 3/2001 Bracque et al.

FOREIGN PATENT DOCUMENTS

DE 2947347 5/1981
DE 19737520 3/1999

* cited by examiner

*Primary Examiner*—William C. Doerrler
(74) *Attorney, Agent, or Firm*—Millen, White, Zelano & Branigan, P.C.

(57) ABSTRACT

Temperature related changes in dimension in a column system, having at least one separating column, a column vessel and a coldbox with coldbox casing, can be compensated for by providing for axial and/or radial movement. The column vessel is connected to the coldbox casing slidably in the axial and/or radial direction by means of radial, rigid connecting members (3, 3*a*, 3*b*, 3*c*, 3*d*).

37 Claims, 3 Drawing Sheets

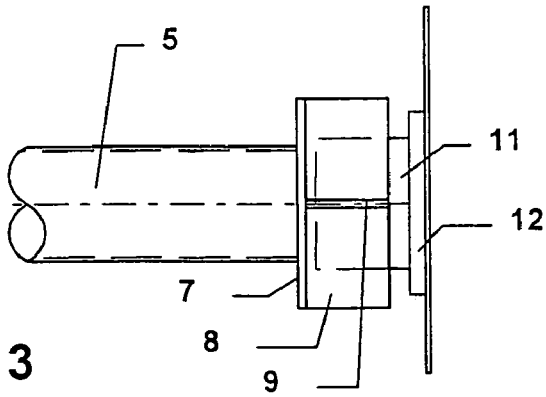
Fig. 3
Fig. 4
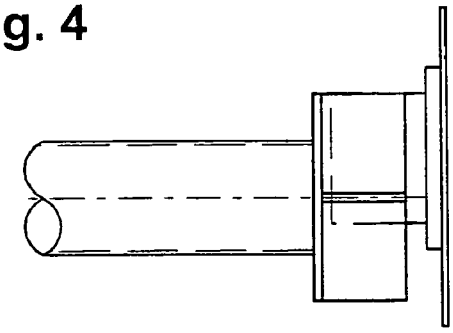
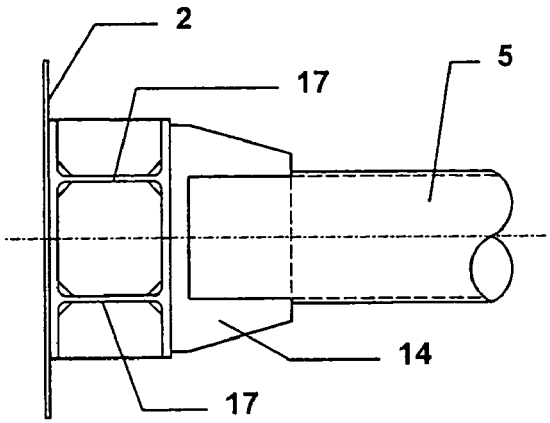
Fig. 5

COLUMN SYSTEM AND PROCESS FOR PRODUCING SAME

The invention relates to a column system having at least one separating column, a column vessel and a coldbox which has a coldbox casing, characterized by radial connecting members between the column vessel and coldbox casing, which are connected to the column vessel and/or to the coldbox casing slidably in the axial and/or radial direction.

The operating temperature of gas fractionation installations is generally different from ambient temperature. By way of example, natural gas or air fractionation installations are operated at low temperatures below ambient temperature. The separating columns used in installations of this type are provided with an insulating jacket, known as a coldbox. The coldbox has a casing, which may comprise one or more layers. The space between the coldbox casing and the outer wall of the column is generally filled with pulverulent insulating materials (for example Perlite).

For example, it is known from DE 2947347 A1 to secure a separating column in the coldbox by suspending it so that it can swing. In EP 913653 A1, it is proposed that the column be introduced into the horizontal coldbox rolling on rails. DE 19737520 A1 discloses securing the column by means of cable.

An aspect of the invention is to provide a column system which makes it possible to compensate for temperature-related changes in dimensions while the column is being brought to its operating temperature and which is particularly economical to produce.

Upon further study of the specification and appended claims, further aspects and advantages of this invention will become apparent to those skilled in the art.

In accordance with the invention there are provided radial connecting members between the column vessel and coldbox casing, which are connected to the column vessel and/or to the coldbox casing slidably in the axial and/or radial direction. In the invention, the clamping between column vessel and coldbox casing is effected by means of radial connecting members. However, these connecting members are connected to the column vessel and/or the coldbox casing in such a way that the column can slide axially and/or radially relative to the coldbox casing during operation, in particular during start-up, of the installation.

This serves to avoid mechanical stresses while the column is being brought to its operating temperature. It is preferable for the connection to be designed slidably in both the radial and axial directions, so that when the installation is being cooled down, the temperature-induced contraction of the column is not impeded in any direction.

Separating columns and their vessels are usually cylindrical or of a similar shape. The terms "column axis", "axial", "radial" and "tangential" used here are based on the cylinder axis or a comparable preferred direction of the column. When the column is operating, the column axis is vertical.

The "column vessel" may be formed completely or partially by the outer wall of the separating column. It may surround one or more columns (for example double or multiple columns), and, in addition to the column(s), further apparatus parts, such as condensers or the like.

The invention is not fundamentally dependent on the shape of the coldbox casing. It can be used, for example, for cuboidal or cylindrical coldboxes. It is particularly preferably employed for substantially cylindrical coldboxes. Coldboxes of this type are used in particular if a column vessel which, for example, has only a single column (for example the high-pressure column or the low-pressure column of a two-column air fractionator), if appropriate with an evaporator or condenser assigned to this column, is insulated separately from other apparatus parts, such as the main heat exchanger for cooling the gas which is to be separated or further separation columns. In the invention, the load is introduced substantially tangentially into the column and/or into the casing.

In the invention, it is preferable for the connecting members to be formed from one or more rigid elements. In this context, the term "rigid" is to be understood as meaning inflexible elements, such as profiled sections, bars, plates, tubes, etc., and represents a demarcation from cables for similar flexible elements.

The connecting members can be connected to the column vessel slidably in the axial direction (and rigidly to the coldbox casing) or to the coldbox casing slidably in the axial direction (and rigidly to the column vessel) or axially slidably to both components.

The connecting members can be connected to the column vessel slidably in the radial direction (and rigidly to the coldbox casing) or to the coldbox casing slidably in the radial direction (and rigidly to the column vessel) or radially slidably to both components.

It is preferable for the connecting members to be connected slidably in the axial and/or radial direction to the column vessel and in a nonpositively locking manner in the axial and/or radial direction to the coldbox casing, i.e. the column can slide axially and/or radially with respect to the connecting members, which for their part do not move in the axial and/or radial direction with respect to the coldbox casing. In practice, by way of example, it is expedient if on one side there is a connection between column vessel and connecting members which is slidable in both the axial and radial directions, and on the other side the connecting members are connected to the coldbox casing in a nonpositively locking manner with respect to all directions.

At least three connecting members are arranged in a plane perpendicular to the column axis, and it is preferably for there to be four such members which, by way of example, are in each case offset through 90°. A greater number of connecting members in one plane is theoretically possible, but does not result in any significant improvement.

It is expedient if the connecting members each have two spokes which are arranged at an angle to one another and face the column vessel at their intersection point and the coldbox casing at their other end. The spokes are formed, for example, by tubes, for example round Cr—Ni tubes. Both spokes of a connecting member preferably lie in an axial plane. The angle between them is, for example, 0° to 160°, preferably 90° to 140°.

The sliding connection between column vessel (or coldbox casing) and connecting member can be formed by a bar, which is connected in a nonpositively locking manner to the column vessel (or the coldbox casing), in combination with a guide, which engages around the bar and is connected in a nonpositively locking manner to the connecting member in question. The bar preferably runs in the axial direction and may, for example, be rectangular in cross section, surrounded by a correspondingly U-shaped guide on three sides. On both opposite sides, the guide preferably has a small spacing of 0 to 3 mm, preferably 0.5 to 1.5 mm. As an alternative or in addition, the guide or strip may be provided with a sliding coating, for example by means of PTFE inlays.

If the guide is connected in a nonpositively locking manner to the intersection point of the spokes, only one corresponding sliding bearing is required per connecting member.

Moreover, it is preferable for at least some of the connecting members to be connected to the coldbox casing adjustably in the radial direction. This measure is used to compensate for tolerances and to avoid complex adaptation work, if the coldbox casing is not perfectly cylindrical. In the case of tubular spokes, this type of connection can be produced by the tubes being axially slotted and a metal sheet which is connected to the coldbox casing in a nonpositively locking manner being introduced into the slot. After the column has been assembled, this connection is preferably made in a nonpositively locking manner, for example by welding. Temperature-induced changes in length are then compensated for independently of the compensation for radial manufacturing tolerances. (Alternatively, it would be possible to produce a corresponding adjustable connection between connecting members and column vessel if there is a sliding connection between connecting members and coldbox casing.)

In particular for horizontal transportation of the column system, it may be expedient if the system has a support which runs substantially tangentially with respect to the column vessel and connects at least one radial connecting member to the coldbox casing. A transportation securing means of this type does not have to be removed after erection of the column if, according to the invention, there is a sliding connection between column vessel, on the one hand, and connecting member and support, on the other hand. This simplifies erection of the column system and makes it less expensive.

In the present context, the term "substantially tangentially" is to be understood as meaning a direction which deviates by no more than 45°, preferably no more than 30°, particularly preferably no more than 15°, from the geometric tangential.

It is preferable for the support to be connected to a section of the corresponding connecting member which faces the column vessel. This increases the stability of the transportation securing.

Moreover, the invention relates to a process for producing a column system in which the column vessel is introduced into the coldbox in such a way that radial connecting members, which are connected to the column vessel and to the coldbox casing, slide in the axial direction along the column vessel and/or along the coldbox casing. This process is suitable in particular for upright assembly of the column system, but can also be used for horizontal assembly.

The invention further relates to a process for producing a column system in which the column vessel is introduced into the coldbox, the column system which has been preassembled in this way is transported to the erection site, and substantially tangentially running support(s), which act as transportation securing means when the column of the column system is horizontal, remain in the coldbox after the column system has been erected.

Moreover, the invention relates to an application of these processes for producing a column system according to the invention as described above and below.

BRIEF DESCRIPTION OF THE DRAWINGS

The invention and further details, such as features and attendant advantages, of the invention are explained in more detail below on the basis of exemplary embodiments which are diagrammatically depicted in the drawings, in which like reference characters designate the same or similar parts throughout the several views, and wherein:

FIG. 3 shows the same connecting member in side view in the operating state, FIG. 4 shows a partial lateral view of a connecting member during assembly, FIG. 5 shows that side of the connecting member which faces the coldbox casing.

DETAILED DESCRIPTION OF THE DRAWINGS

Figure 1:
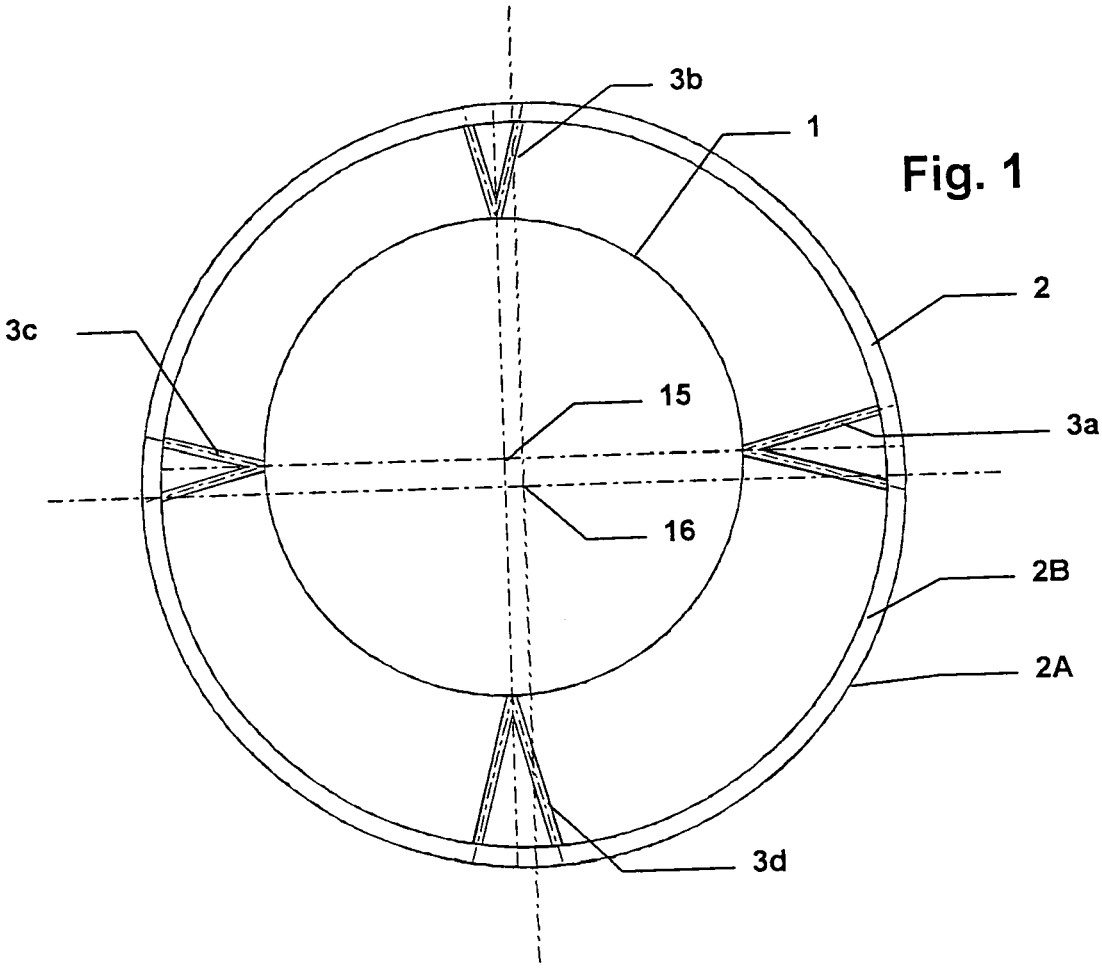
FIG. 1 shows a cross section through the coldbox in the assembled state (first embodiment)

In accordance with FIG. 1, a column vessel 1 is arranged in the interior of a coldbox which has a coldbox casing 2. (The interior of the column is not shown in the drawing, and nor are other details, such as pipes and their connections.) In the example, the coldbox casing 2 comprises a sheet-metal sleeve 2A, which is welded onto a framework or is reinforced by annular reinforcements (framework and reinforcements are indicated at 2B in FIGS. 1 and 2). Between the inner side of the coldbox casing and the outer side of the column vessel there are four connecting members 3*a*, 3*b*, 3*c*, 3*d*, which each have two spokes. The connecting member 3*a*, 3*b*, 3*c*, 3*d* are arranged in the plane of the drawing and in this example are offset by in each case 90° with respect to one another. Their substantially identical structure is presented in the detailed drawings.

The column system preferably has precisely one such ring of connecting members, which is arranged in the vicinity of the upper end of the column. Alternatively, it is possible for one or more identical or similar rings to be arranged axially offset.

Figure 2:
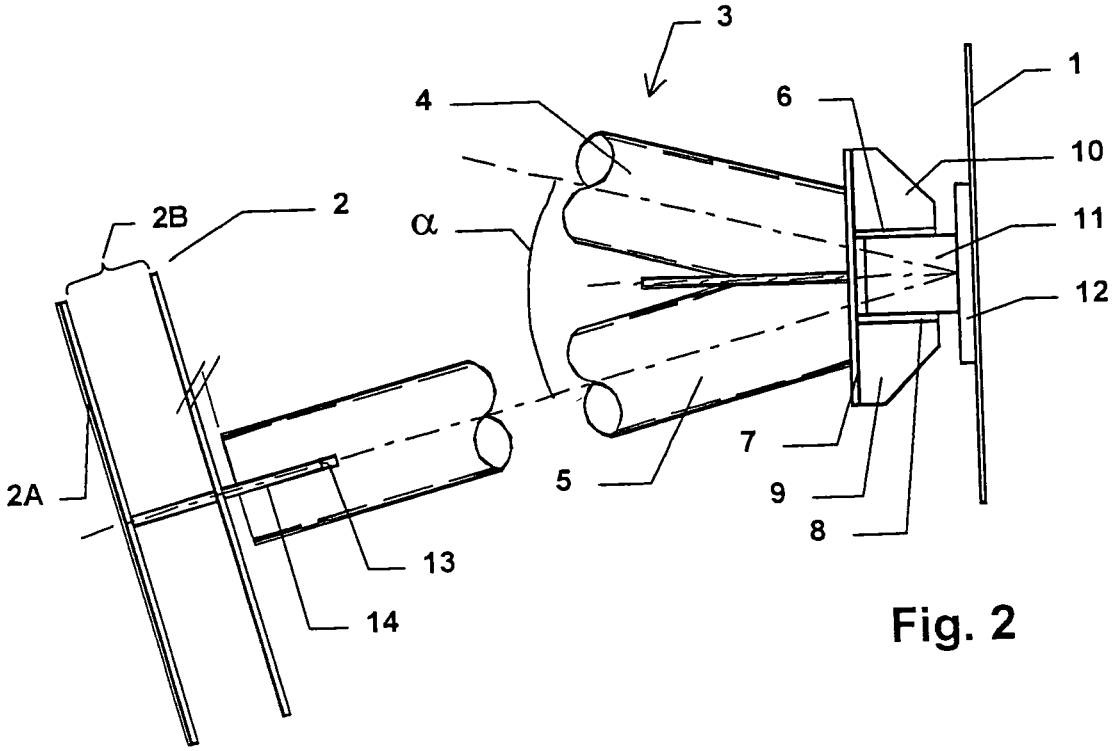
FIG. 2 shows a plan view of a connecting member.

FIG. 2 shows the same direction of viewing as in FIG. 1. The left-hand side of the figure shows the coldbox casing 2 with sleeve 2A and ring reinforcement 2B, and the right-hand side shows the outer wall of the column vessel 1. The two limbs or spokes 4, 5 of the connecting member 3 are made from round Cr—Ni tubes. At their column-side end, they meet at an angle $\alpha$ of approximately 30° (in each case $\alpha/2=15°$ with respect to the radius of the column). Three Cr—Ni sheets 6, 7, 8, arranged at right angles to one another, with strengthening members 9, 10 form a guide which surrounds a strip formed by a rectangular aluminium carrier 11. The strip 11 is fixedly connected to the column vessel 1 via a metal reinforcing sheet 12. The guide 6, 7, 8 can slide along the guide 11 perpendicular to the plane of the drawing. This allows a relative movement between coldbox casing 2 and column vessel 1 in the axial direction, i.e. the column can execute temperature-induced length and diameter changes without obstacle, in particular without regard to the coldbox casing. At the same time, overall, there is a force-transmitting connection between column vessel and coldbox perpendicular to the radial and axial contraction. This connection means that these two apparatus parts are supported against one another in the event of the need to dissipate loads. The result is a harmonic introduction of loads into column and coldbox casing and a mechanical connection between column vessel and coldbox casing in order to dissipate horizontal forces, for example from earthquakes (column to casing) or wind forces (casing to column).

At the opposite end of the connecting member (left-hand side of FIG. 2), just one of the two spokes, i.e., spoke 5, is illustrated, by way of example; the other is of a similar structure. The tube end is slotted. The gap 13 in the example runs vertically and receives an upright Cr—Ni sheet 14 which is welded to the coldbox casing 2. The adjustable bearing between spoke 5 and metal sheet 14 makes it possible to compensate for radial tolerances. After the column has been erected during assembly, the metal sheet 14 is welded to the spoke 5. FIG. 5 shows a connection between spoke 5, via the metal sheet 14, to the coldbox casing 2 reinforced by means of ribs 17, in side view.

The other connecting members are substantially identical to those shown in FIGS. 2 and 3. The coldbox can concentrically surround the column. Alternatively, an eccentric arrangement is possible, as illustrated—in quantitatively exaggerated form—in FIG. 1; the column axis 15 and the coldbox axis 16 are in this case not identical. Sliding the metal sheet 14 more or less far into the gap 13 makes it possible to compensate for the correspondingly different distances between column vessel 1 and coldbox casing 2.

The side view shown in FIG. 3 illustrates the connection to the column wall 1 during operation of the installation. FIG. 4, by contrast, shows the same arrangement immediately after assembly, at ambient temperature. When the installation is being cooled down, the column contracts and slides downwards relative to the coldbox, along the guide 6, 7, 8, until the strip 11 has reached the position illustrated in FIG. 3.

Figure 6:
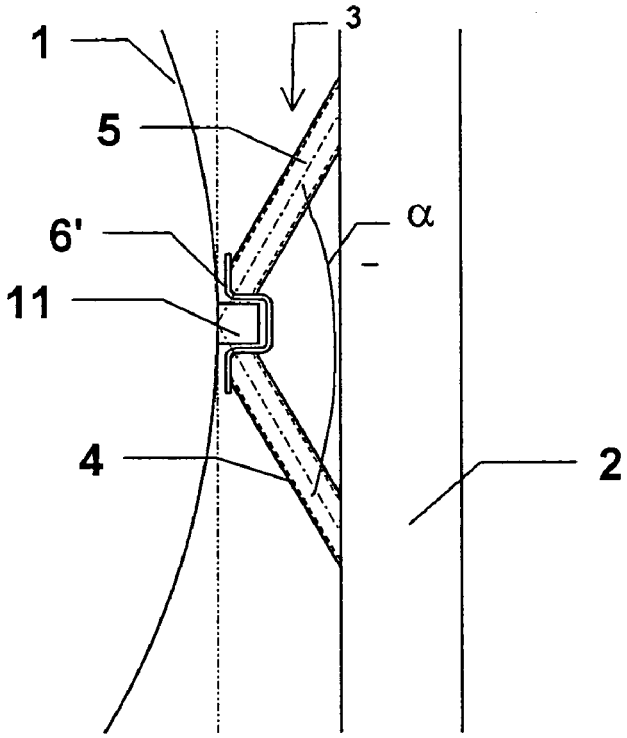
FIG. 6 shows the connecting member of a second embodiment of the invention.

FIG. 6 shows a second embodiment of the invention, in which the angle $\alpha$ between the two limbs 4, 5 of the connecting member 3 illustrated between column vessel 1 and coldbox casing 2 is significantly greater than in the first exemplary embodiment. In this case, it is 125°. The guide 6' around the strip 11 is in this case of single-piece configuration and comprises a metal sheet which has been bent a number of times.

This results in particularly advantageous introduction of loads into the coldbox casing, in particular if the coldbox casing is designed as a plane load-bearing structure. In this case, local reinforcing measures are generally not required. Moreover, the connecting members have a particularly small overall size.

Figure 7:
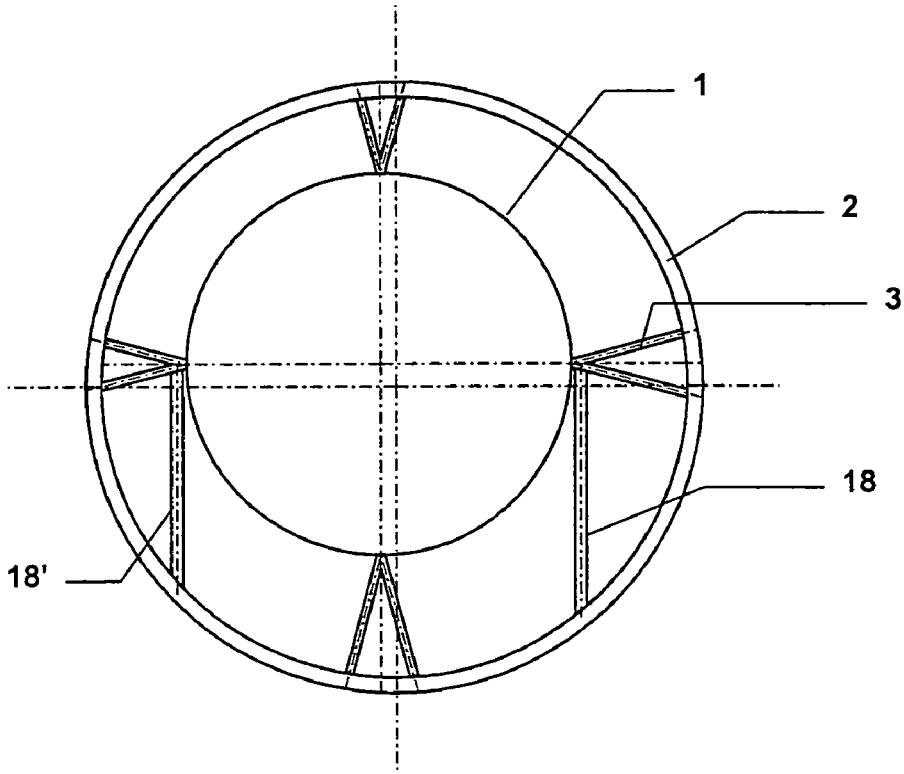
FIG. 7 shows the embodiment shown in FIG. 1 with transportation support.

A pair of substantially tangentially running supports 18, 18' as transportation securing means when the column of the column system is horizontal is illustrated in FIG. 7. Otherwise, FIG. 7 does not differ from FIG. 1. The support 18 is connected to the connecting member 3 in the vicinity of the column-side end. The guide illustrated in FIG. 2 simultaneously serves as an abutment for the support 18. The supports 18, 18', unlike known transportation securing means, can be remain in the coldbox after the unit has been erected. There is no need for a complex working step to remove the transportation securing means.

From the foregoing description, one skilled in the art can easily ascertain the essential characteristics of this invention and, without departing from the spirit and scope thereof, can make various changes and modifications of the invention to adapt it to various usages and conditions.

The entire disclosure of all applications, patents and publications, cited above and below, and of corresponding German Application No. 103 19 755.9, filed Apr. 30, 2003 is hereby incorporated by reference.

The invention claimed is:

1. A column system comprising:

at least one vertically disposed separating column comprising a column vessel (1) containing fractionating means, and a coldbox having a coldbox casing (2), and radial connecting members (3, 3*a*, 3*b*, 3*c*, 3*d*) between said column vessel (1) and said coldbox casing (2), which are slidably connected in the axial and/or radial direction to said column vessel (1), said coldbox casing (2), or both.

2. A column system according to claim 1, wherein connecting members (3, 3*a*, 3*b*, 3*c*, 3*d*) are constructed from one or more rigid elements (4, 5, 6, 7, 8, 9, 10, 11, 12, 13).

3. A column system according to claim 1, wherein at least some of the connecting members (3, 3*a*, 3*b*, 3*c*, 3*d*) are slidably connected in the axial direction to said column vessel (1), said coldbox casing (2), or both.

4. A column system according to claim 1, wherein at least some of the connecting members (3, 3*a*, 3*b*, 3*c*, 3*d*) are slidably connected in the radial direction to said column vessel (1), said coldbox casing (2), or both.

5. A column system comprising:

at least one separating column comprising a column vessel (1) and a coldbox comprising a coldbox casing (2), and radial connecting members (3, 3*a*, 3*b*, 3*c*, 3*d*) are connected (6, 7, 8, 11, 13, 14), slidably in the axial direction, radial direction, or both, to the column vessel (1) and, in a nonpositively locking manner in the axial direction, radial direction, or both to the coldbox casing (2).

6. A column system according to claim 1, wherein at least three connecting members (3*a*, 3*b*, 3*c*, 3*d*) are arranged in a plane which is perpendicular to the column axis (15).

7. A column system according to claim 6, wherein four connecting members are arranged in a plane which is perpendicular to the column axis (15).

8. A column system according to claim 1, wherein connecting members (3, 3*a*, 3*b*, 3*c*, 3*d*) each have two spokes (4, 5) which are arranged at an angle to one another and face said column vessel (1) at their intersection point and face said coldbox casing (2) at their other end.

9. A column system comprising:

at least one separating column comprising a column vessel (1), and a coldbox having a coldbox casing (2), radial connecting members (3, 3*a*, 3*b*, 3*c*, 3*d*) between said column vessel (1) and said coldbox casing (2), which are slidably connected in the axial and/or radial direction to said column vessel (1), said coldbox casing (2), or both, and wherein the sliding connection is formed by a strip (11), which is connected in a nonpositively locking manner to said column vessel or said coldbox casing, in combination with a guide (6, 7, 8) which engages around said strip and is connected in a nonpositively locking manner to the respective connecting member (3, 3*a*, 3*b*, 3*c*, 3*d*).

10. A column system according to claim 8, wherein the sliding connection is formed by a strip (11), which is connected in a nonpositively locking manner to said column vessel or said coldbox casing, in combination with a guide (6, 7, 8) which engages around said strip and is connected in a nonpositively locking manner to the respective connecting member (3, 3*a*, 3*b*, 3*c*, 3*d*), and wherein said guide (6, 7, 8) is connected in a nonpositively locking manner to the intersection point of spokes (4, 5).

11. A column system according to claim 1, wherein at least some of the connecting members (3, 3*a*, 3*b*, 3*c*, 3*d*) are connected (13, 14) to the coldbox casing adjustably in the radial direction.

12. A column system according to claim 1, wherein by at least one support (18, 18'), which runs substantially tangentially with respect to the column vessel, connects at least one radial connecting member (3) to the coldbox casing (2).

13. A column system according to claim 12, wherein support (18) is connected to a section of the corresponding connecting member (3) which faces the column vessel.

14. A column system according to claim 8, wherein the angle between said spokes is 0° to 160°.

15. A column system according to claim 8, wherein the angle between said spokes is 90° to 140°.

16. A process for producing a column system comprising at least one separating column comprising a column vessel (1) containing fractionating means, and a coldbox having a coldbox casing (2), radial connecting members (3, 3*a*, 3*b*, 3*c*, 3*d*) between said column vessel (1) and said coldbox casing (2), which are slidably connected in the axial and/or radial direction to said column vessel (1), said coldbox casing (2), or both, said process comprising introducing said column vessel into the coldbox in such a way that radial connecting members (3, 3*a*, 3*b*, 3*c*, 3*d*), which are connected to the column vessel (1) and to the coldbox casing (2), slide in the axial direction along the column vessel (1), the coldbox casing(2), or both.

17. A process for producing a column system according to claim 12, comprising introducing said column vessel into the coldbox, erecting the column in a vertical disposition, and wherein said at least one substantially tangentially running support remains in the coldbox after the column system has been erected.

18. A process according to claim 16, wherein connecting members (3, 3*a*, 3*b*, 3*c*, 3*d*) are constructed from one or more rigid elements (4, 5, 6, 7, 8, 9, 10, 11, 12, 13).

19. A process according to claim 16, wherein at least some of the connecting members (3, 3*a*, 3*b*, 3*c*, 3*d*) are slidably connected in the axial direction to said column vessel (1), said coldbox casing (2), or both.

20. A process according to claim 16, wherein connecting members (3, 3*a*, 3*b*, 3*c*, 3*d*) are slidably connected in the radial direction to said column vessel (1), said coldbox casing (2), or both.

21. A process according to claim 16, wherein radial connecting members (3, 3*a*, 3*b*, 3*c*, 3*d*) are connected (6, 7, 8, 11, 13, 14), slidably in the axial direction, radial direction, or both, to the column vessel (1) and, in a nonpositively locking manner in the axial direction, radial direction, or both to the coldbox casing (2).

22. A process according to claim 16, wherein at least three connecting members (3*a*, 3*b*, 3*c*, 3*d*) are arranged in a plane which is perpendicular to the column axis (15).

23. A process according to claim 22, wherein four connecting members are arranged in a plane which is perpendicular to the column axis (15).

24. A process according to claim 16, wherein connecting members (3, 3*a*, 3*b*, 3*c*, 3*d*) each have two spokes (4, 5) which are arranged at an angle to one another and face said column vessel (1) at their intersection point and face said coldbox casing (2) at their other end.

25. A process according to claim 16, wherein at least some of the connecting members (3, 3*a*, 3*b*, 3*c*, 3*d*) are connected (13, 14) to the coldbox casing adjustably in the radial direction.

26. A process according to claim 16, wherein by at least one support (18, 18'), which runs substantially tangentially with respect to the column vessel, connects at least one radial connecting member (3) to the coldbox casing (2).

27. A column system according to claim 5, wherein connecting members (3, 3*a*, 3*b*, 3*c*, 3*d*) are constructed from one or more rigid elements (4, 5, 6, 7, 8, 9, 10, 11, 12, 13).

28. A column system according to claim 5, wherein at least some of the connecting members (3, 3*a*, 3*b*, 3*c*, 3*d*) are slidably connected in the axial direction to said column vessel (1), said coldbox casing (2), or both.

29. A column system according to claim 5, wherein connecting members (3, 3*a*, 3*b*, 3*c*, 3*d*) are slidably connected in the radial direction to said column vessel (1), said coldbox casing (2), or both.

30. A column system according to claim 5, wherein at least three connecting members (3*a*, 3*b*, 3*c*, 3*d*) are arranged in a plane which is perpendicular to the column axis (15).

31. A column system according to claim 30, wherein four connecting members are arranged in a plane which is perpendicular to the column axis (15).

32. A column system according to claim 5, wherein connecting members (3, 3*a*, 3*b*, 3*c*, 3*d*) each have two spokes (4, 5) which are arranged at an angle to one another and face said column vessel (1) at their intersection point and face said coldbox casing (2) at their other end.

33. A column system according to claim 5, wherein by at least one support (18, 18'), which runs substantially tangentially with respect to the column vessel, connects at least one radial connecting member (3) to the coldbox casing (2).

34. A column system according to claim 33, wherein support (18) is connected to a section of the corresponding connecting member (3) which faces the column vessel.

35. A column system according to claim 32, wherein the angle between said spokes is 0° to 160°.

36. A column system according to claim 32, wherein the angle between said spokes is 90° to 140°.

37. A column system according to claim 1, comprising separate means for connecting the radial connecting members slidably in the axial direction to said column vessel (1), said cold box casing (2), or both, and separate means for connecting the radial connecting members in the radial direction to said column vessel (1), said cold box casing (2), or both.

* * * * *